United States Patent [19]

Gillum

[11] 4,286,499

[45] Sep. 1, 1981

[54] CROSS AXIS SHELL FEEDING APPARATUS FOR FIREARMS

[76] Inventor: Richard R. Gillum, 1002 Lake St., Marblehead, Ohio 43440

[21] Appl. No.: 87,786

[22] Filed: Oct. 24, 1979

[51] Int. Cl.[3] ..... F41D 10/20

[52] U.S. Cl. ..... 89/33 B; 42/18; 42/50

[58] Field of Search ..... 42/6, 18, 50; 89/33 A, 89/33 B

[56] References Cited

U.S. PATENT DOCUMENTS

| | | | |
|---|---|---|---|
| 789,142 | 5/1905 | Chichester . | |
| 1,451,339 | 4/1923 | Kottas . | |
| 2,041,015 | 5/1936 | Onorati | 42/69 |
| 2,358,792 | 9/1944 | Conway | 42/17 |
| 2,448,081 | 8/1948 | Conway | 42/17 |
| 2,479,770 | 8/1949 | Olson | 42/17 |
| 2,624,241 | 1/1953 | Hill | 89/33 B |
| 2,758,403 | 8/1956 | Hill | 42/17 |
| 2,882,635 | 4/1959 | Hill | 42/17 |
| 3,064,382 | 11/1962 | Hill | 42/25 |
| 3,167,876 | 2/1965 | Milroy, Jr. | 42/7 |

*Primary Examiner*—Stephen C. Bentley
*Attorney, Agent, or Firm*—Allan R. Fowler

[57] ABSTRACT

Cross axis shell feeding apparatus for firearms comprises symmetrical shell pivoting or turnaround means having an internal pivoting chamber configured for receiving, and pivoting through 90°, shells from an associated linear shell magazine in which the shells are loaded in either cross axis direction. The shell pivoting chamber, formed having shell engaging, or camming surfaces which cam the shells through 90° of rotation, is shown configured for pivoting tapered casing, rifle-type shells. Shells are pushed forwardly through the shell pivoting means by first and second stage rammers mounted to reciprocate with the firearm bolt assembly. To prevent jamming of shells being pivoted 90° in the shell pivoting means, shell engaging portions of the first stage rammer swing aside after a shell has been pivoted from an initial cross axis orientation through approximately 75°. At that point, the second stage rammer drivingly engages the shell base, causing continued shell pivoting through 90° and pushing the shell on through the shell pivoting means. The bolt assembly is configured for them pushing the shell into the firing chamber and firing the shell. The associated shell magazine, which is enabled to be straight because of alternatingly pointing shells, is detachably mounted along flat upper regions of the firearm and has a longitudinal axis parallel to the barrel bore axis.

9 Claims, 19 Drawing Figures

FIG. 5.
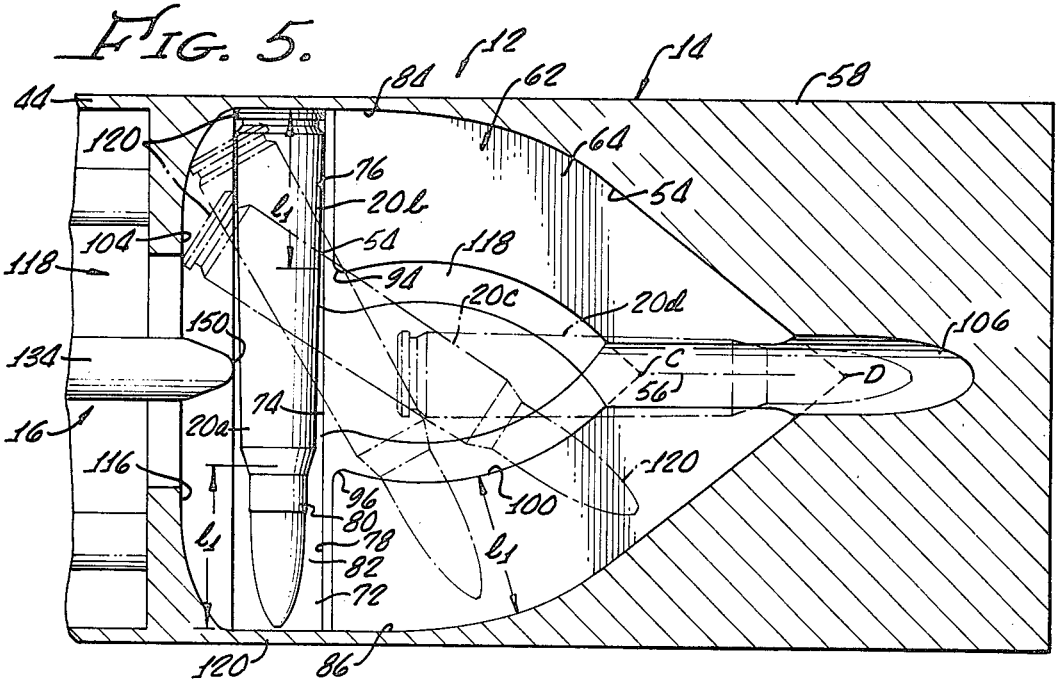
FIG. 6.
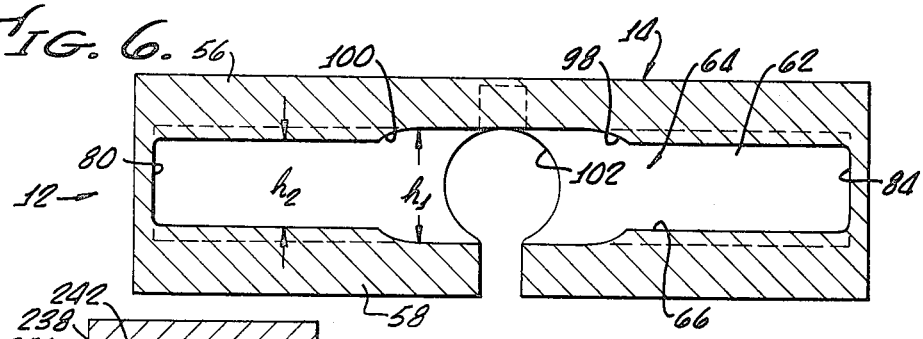
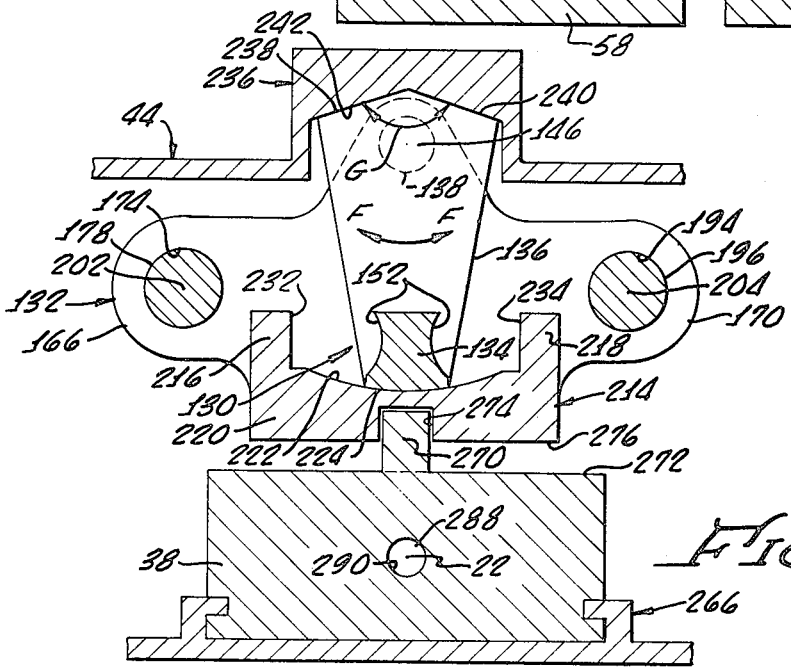
FIG. 8.

CROSS AXIS SHELL FEEDING APPARATUS FOR FIREARMS

The present invention relates generally to the field of shell feeding apparatus for repeating guns, and more particularly, to cross feeding apparatus which pivot shells through 90 degrees while feeding.

Large shell capacity is necessary for most types of military firearms, particularly those capable of rapid, semi-automatic or fully automatic firing. In addition, a relatively large shell capacity is often desirable on many types of law enforcement and sporting firearms.

With the exception of belt fed machine guns, virtually all rapid firing, hand carried firearms are configured to use either drum or clip shell magazines which can be changed to replace empty magazines with full magazines.

Drum magazines, which generally provide large shell capacity, are, or have been, used on many types of military firearms, particularly those of foreign countries, to enable massive fire power by infantry troops. Some use of drum magazine has been made in the United States, for example, on the Thompson 0.45 calibre submachine gun, known as the "tommy gun".

In spite of usually much greater shell capacity of drum magazines, clip magazines have, however, generally been preferred in this country, and many other countries, because of their greater mechanical simplicity, shell feeding reliability and ease of changing. Also spare clip magazines are easier to carry, as are firearms with clip magazines attached.

As a result of feed spring limitations, and for reliable feeding, clip magazines for fully automatic firearms are typically limited to a maximum of about 30–35 shells, the shells being usually arranged in a staggered double column for large capacities to minimize magazine length. For straight cased shells, such as pistol ammunition, straight clip magazines are used; whereas, for shells having tapered cases, large capacity clips are necessarily slightly curved, being commonly referred to as "banana" clips because of their appearance.

In spite of their many advantages, large capacity, for example, for military weapons, clip magazines have the particular disadvantage of projecting substantially, often in an awkward manner, from the associated firearm. Even where means are provided to enable reliable feeding of a larger number of shells than the mentioned usual 30–35 shells, the weapons are unwieldly to use and carry. As an illustration, 50 round clips for 0.45 calibre automatic pistols are available; however, they project about two feet from the handle, making the gun very awkward.

Various attempts have consequently been made to provide large shell capacity for firearms without necessity either for drums or for awkwardly projecting clip magazines. Several U.S. patents have, as an illustration, disclosed construction of firearms having integral box magazines configured for accepting an entire, standard box of 50 shells. Representative of such patents are those of Chichester, Conway, Olson and Gamble (U.S. Pat. Nos. 789,142; 2,358,792; 2,479,770 and 2,623,803 respectively). Similar integral magazines which accept large numbers of shells, but not in a complete box form, are disclosed in the United States patents of Conway and Milroy, Jr. (U.S. Pat. Nos. 2,448,081 and 3,167,876, respectively). Common to such disclosed magazines is that, to minimize space requirements, the shells are arranged with longitudinal shell axis at right angles to the barrel bore axis. The shells are also loaded in a staggered, cross axis arrangement with adjacent shells pointing to opposite sides of the firearms, in the same manner that shells are ordinarily boxed.

Still other types of firearms have been disclosed in which shells are internally loaded in such cross axis relationship, but all pointing in the same direction. Such firearms are disclosed, for example, in several United States patents of Hill (U.S. Pat. Nos. 2,624,241; 2,758,403; 2,882,635 and 3,064,381). As a further illustration, the U.S. patent of Onorati (U.S. Pat. No. 2,041,015) discloses an arrangement of shells in a pistol in which all the shells point downwardly at right angles to the bore axis, instead of to one side of the firearm.

Still further, the U.S. Pat. No. 1,451,339 to Koltas discloses a pistol having cross axis oriented shells loaded into a labyrinth passage formed through the pistol handle and attached shoulder stock.

In general, all of the above mentioned patents disclose firearms using relatively short pistol or straight sided rifle shells. Accordingly, loading the shells in the described cross axis orientation does not add substantially to the necessary width of the firearms, as would use large calibre rifle shells.

The principle advantage of such cross axis shell loading is that many more shells can be loaded in the firearm than with conventional linear magazines. However, this requires that, during feeding, the shells be rotated 90 degrees from their cross axis orientation into alignment with the barrel firing chamber. In addition, in those types of firearms in which the shells are loaded in alternating relationship, with adjacent shells pointing in opposite directions, the shell rotating apparatus must also discriminate between loading orientation and cause rotating of shells in both orientations into the correct shell pointing direction.

As is well known to those familiar with firearms, a major problem with rapid fire firearms, both of semi-automatic and full automatic types, is reliable feeding of shells from the magazine into the firing chamber. Even slight defects or deformities in the magazines, especially in the shell discharge area or feed lips or in the subsequent feed path, usually result in failure to feed properly, particularly at high rates of fire, with consequent gun jamming.

Shell feeding problems associated with conventional shell magazines, in which shells in the magazine shell feed region are parallel to, and nearly aligned with, the barrel bore axis are very greatly increased when shell rotational movement, in addition to translational movement, is necessary.

As an illustration of problems encountered, when shell rotation controlling gates, such as those types disclosed by Conway (U.S. Pat. No. 2,358,792), are used, in which edges of the gate function as shell pivot points for shells engaged in the rim area, the rims tend to catch or hang up on the edges. When this occurs, the shells fail to feed forwardly. These gate-type apparatus also require some type of shell rammer to drive shells through the gate. However, these rammers also tend to jam the shells to inner sides of the gates, also resulting in failure to feed properly.

To applicant's knowledge, and as evidenced by unavailability or actual use of firearms employing cross axis feed mechanisms in spite of the potential advantages of such type of firearms, no cross axis feed mechanisms have heretofore been successfully applied to rapid fire firearms or to firearms using modern, tapered, rifle shells, loaded in alternatingly relationship.

To achieve the potential advantage of cross axis shell loading, together with other advantages associated with removable magazines, thereby enabling clip magazines to be positioned parallel to the barrel bore axis and generally flush with firearm surfaces, rather than projecting outwardly from the bore axis, applicant has invented an improved cross axis shell feed system. Applicant's apparatus, which enables reliable feeding of cross axis loaded shells of both straight and tapered casing configuration, regardless of shell orientation, includes camming surfaces for guiding rotational movement of the shells and an associated two stage shell rammer for moving the shells along the camming surfaces without causing shell hang ups or jamming.

Applicant's cross axis shell feeding apparatus, for a gun having a barrel with a rearwardly opening firing chamber, comprises shell pivoting means for pivoting shells from a cross axis supply means through 90 degrees, so that longitudinal shell axis are coplanar with the barrel bore axis and the shells are correctly pointing for loading into the firing chamber. The shell pivoting means includes means defining a shell infeed opening positioned to receive shells from the shell supply means and defining a shell outfeed opening at 90 degrees thereto, and has internal camming means for causing 90 degree shell pivoting as a shell is moved from the infeed opening to the outfeed opening.

Shell ramming means are included for pushing shells through the shell pivoting means to thereby cause the 90 degree shell pivoting. The ramming means includes a first stage rammer configured for engaging and pushing shells partially through the shell pivoting means to cause partial 90° shell pivoting, disengaging means for then enabling disengagement of the first stage rammer from the shells, and a second stage rammer configured for then engaging the shells to cause completion of 90° shell pivoting and push the shells the rest of the way through the shell pivoting means.

Also included are means for axially moving the ramming means, in synchronization with firing of the gun, in a reciprocating manner for enabling a sequence of shells to be pushed through the shell rotating means and pivoted 90° therein for feeding from the shell supply means to the firing chamber, and means for moving shells from the outfeed opening of the shell pivoting means into the firing chamber for firing.

More specifically, the first stage rammer, which is formed having an elongate, forwardly extending shell engaging member, is pivotally mounted to the second stage rammer for limited side-to-side pivoting relative thereto. Thus, the first stage rammer is configured and operative, after engaging and pushing shells partially through the shell pivoting means, and thereby causing partial 90 degree shell rotation, for pivoting aside relative to the second stage rammer out of shell engagement. The second stage rammer is cooperatively configured and operative for then engaging the shells to cause completion of 90 degree shell pivoting and pushing of the shells on through said shell pivoting means.

Means are included for enabling the first stage rammer to pivot aside relative to the second stage rammer after the partial 90 degree shell pivoting thereby, and for causing the first stage rammer to return to a central position between shell rammings. This pivoting aside of the first stage rammer out of engagement with shells after partial shell pivoting in the shell pivoting means, and subsequent shell engagement by the second stage rammer for completion of shell pivoting is important for reliable shell feeding. Otherwise, using, for example, a nonpivoting rammer, shells tend to be wedged or jammed in the shell pivoting means by the rammer, and shell feeding is, at best, unreliable even at moderately high firing rates.

The shell pivoting means are symmetrically configured about a longitudinal axis therethrough to enable 90 degree pivotal movement of shells received in either cross axis orientation, thereby enabling shells to be loaded in the supply means in alternating or mixed cross axis orientation. Such permissible shell loading, in turn, enables the shell supply means to advantageously comprise a straight magazine type, even when the shells are of tapered casing, rifle-type, as may be desirable for military weapons and other types of guns. Thus, for such military applications as automatic assault rifles, the linear shell magazine is configured having means defining a shell feeding aperture at one end thereof and means are provided for attaching the magazine to the gun with the shell feeding aperture thereof in proximity to the infeed opening of the shell pivoting means and in an orientation wherein a longitudinal axis of the magazine is substantially parallel to the barrel bore axis.

With such magazine configuration and attachment along the gun, rather than projecting outwardly from the gun, ease of carrying and use is greatly enhanced. In addition, a longer, and hence larger shell capacity, shell magazine can be used than would otherwise be practical.

A better understanding of the present invention may be had from a consideration of the following detailed description, taken in conjunction with the accompanying drawings in which:

FIG. 5 is a cross sectional view, taken along line 5—5 of FIG. 3, looking in the general direction of FIG. 4, showing other features of the shell camming portion of the cross axis shell feeding apparatus;

FIG. 6 is a transverse cross sectional view, taken along line 6—6 of FIG. 3, also showing features of the shell camming portion of the cross axis shell feeding apparatus;

FIG. 8 is a transverse cross sectional view, taken along line 8—8 of FIG. 3, showing other features of actuating portions of the cross axis shell feeding apparatus;

Figure 1:
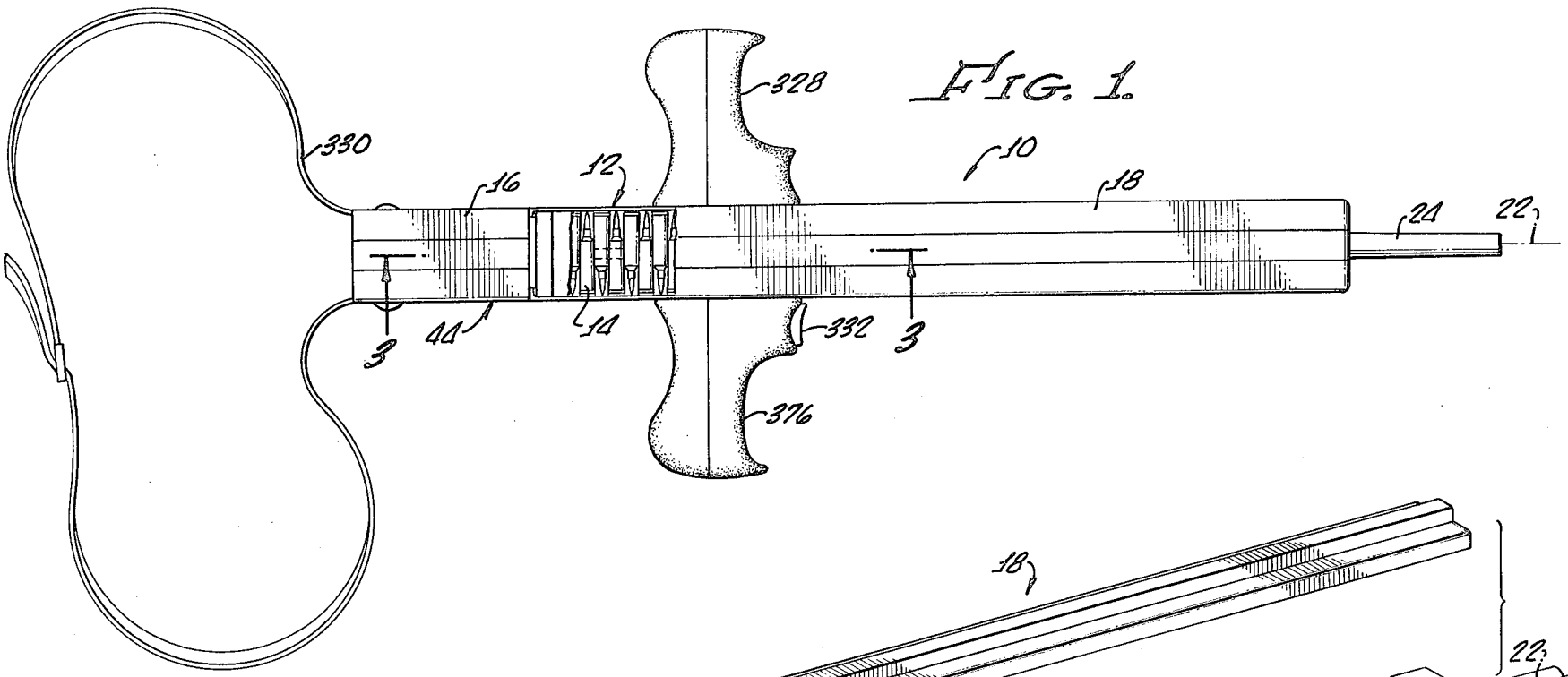
FIG. 1 is a partially cutaway plan view of an exemplary hand held firearm embodying cross axis shell feeding apparatus according to the present invention.
Figure 2:
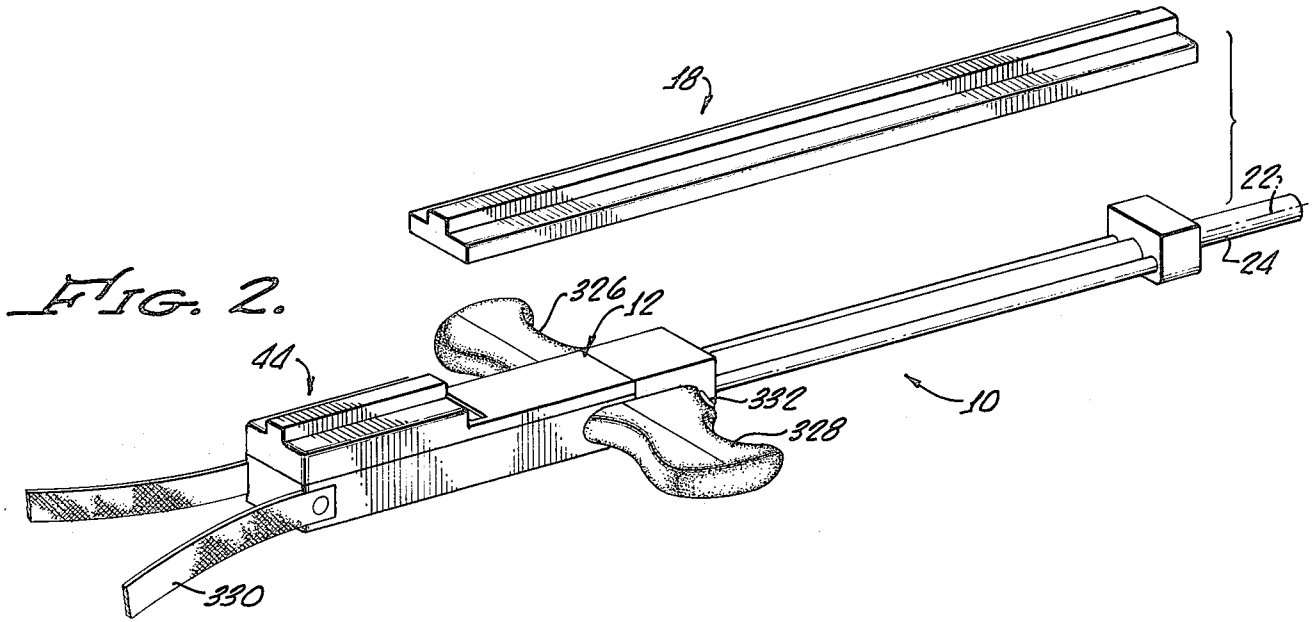
FIG. 2 is a perspective drawing showing, in exploded form, the exemplary firearm and cross axis shell feeding apparatus of FIG. 1.

Shown in FIGS. 1 and 2 is an exemplary hand held firearm 10 which incorporates a cross axis shell feed apparatus 12, in accordance with the present invention. Although the apparatus 12 is adaptable for use with most types of projectile firing weapons, whether or not hand held, the firearm 10, for illustrative purposes and with no limitations intended or implied, is shown to be a two handled, symmetrically held rifle, of the type disclosed in my copending U.S. patent application, Ser. No. 044,567

Figure 3:
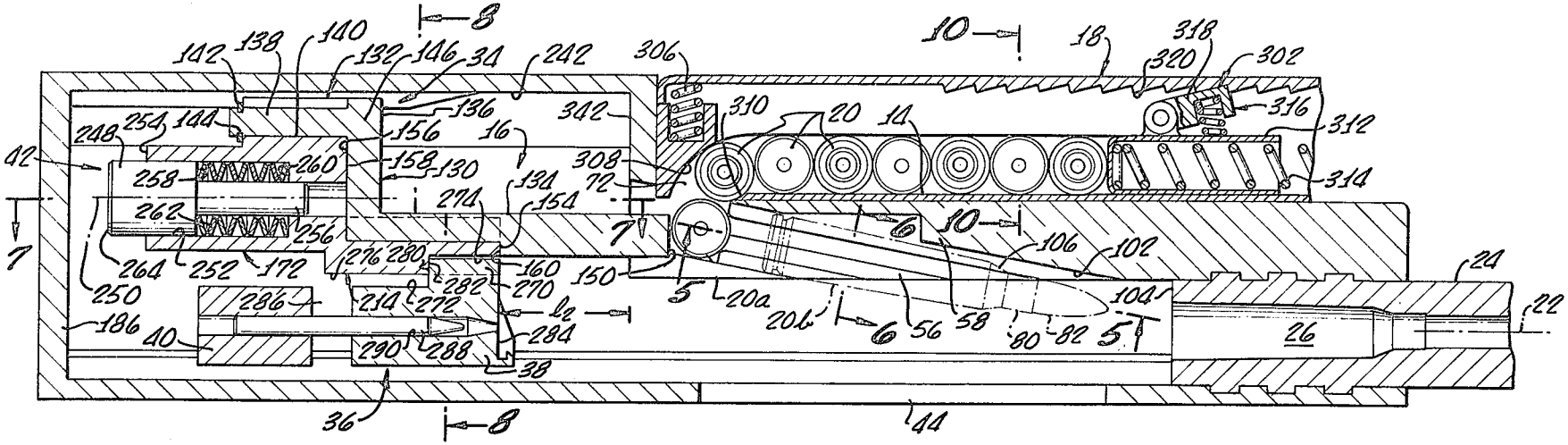
FIG. 3 is a longitudinal cross sectional view, taken along line 3—3 of FIG. 1, showing inner features of the cross axis shell feeding apparatus.

As better seen in FIG. 3, the cross axis shell feed apparatus 12 comprises generally a non-moving, shell turn around or shell pivoting portion or means 14 and an axially reciprocating, shell turnaround actuating portion or shell ramming means 16.

Directly associated and cooperating with the cross axis shell feed apparatus 12 is a detachable shell magazine 18 in which a plurality of shells 20 are loaded in a cross axis relationship relative to a bore axis 22 through a barrel 24 of the firearm 10.

As more particularly described below, the shell turnaround portion 14, in response to the actuating portion 16 pushing individual ones of the shells 20 therethrough, causes the shells to pivot 90° from the cross axis shell loading orientation of the magazine 18 to a proper orientation enabling feeding into a firing chamber 26 formed at a rearward end of the barrel 24. Included in the actuating portion 16 is a two stage or two step shell rammer 34, a bolt assembly 36, which comprises a bolt 38 and a bolt carrier 40, and a spring-type recoil buffer assembly 42.

Internal configuration of the shell turnaround portion 14, which may, as shown, be formed as part of a receiver portion 44 of the firearm 10, is more particularly illustrated in longitudinally and transverse cross sectional views of FIGS. 3 through 6. In FIGS. 3 through 6, a particularly identified shell 20*a* which is to be fed from the magazine 18 into the firing chamber 26, is shown in a cross axis loading orientation, at an in-feed region of the shell turnaround portion 14. For illustrative and comparative purposes, a fully 90° rotated shell 20*b* is also shown (in phantom lines) in the turnaround portion 14, in a position to be picked up for feeding into the firing chamber 26, in a manner described below.

A longitudinal axis 54 of the in feed positioned shell 20*a* is orthogonal to a longitudinal axis 56 of the turnaround portion 14, and hence is also orthogonal to the fully rotated shell 20*b*. In turn, the shell turnaround portion axis 56 is coplaner with (but not necessarily parallel to) the barrel bore axis 22, intersecting such bore axis at an angle "A", which may, for example, be about 10°. This inclination of the turnaround portion 14, relative to the barrel bore axis 22, accommodates the offset of the magazine 18 from the bore axis.

The shell turnaround portion 14 is generally constructed in split, "clam shell" form, having upper and lower half sections 58 and 60, respectively, which define a generally tear drop or heart shaped, flat inner cavity 62 in which the 90° shell pivoting is accomplished. Such inner cavity 62 is transversely symmetrical about the longitudinal axis 56 of the turnaround portion 14.

Configuration of upper and lower inner walls 64 and 66, respectively, of the turnaround portion upper and lower half sections 58 and 60, which internally define the cavity 62, controls pivotal movement of shells fed through the turnaround portion 14. In consequence, and as can readily be appreciated, although generally similar in configuration for different types and sizes of shells, the cavity defining inner surfaces 64 and 66 must be specifically contoured to correspond generally to the size and shape of the particular configuration of the shells 20 to be fed through the cavity 62.

For illustrating the manner in which the cavity defining surfaces 64 and 66 are contoured, the shells 20 (including the shells identified as 20*a* and 20*b*) are assumed to be the tapered casing type commonly associated with rifle shells, and may, for example, be of a conventional 0.223 calibre (5.56 mm) size. Without requiring substantial shape changes to the cavity 62, although cavity size would necessarily need to be increased, the shells 20 could alternatively, for example, be conventional 7.62 mm (NATO) or 30.06 calibre size for larger hand held firearms or of 0.50 calibre, 20 mm or larger size for non-hand held firearms.

Transverse symmetry of the cavity 62 and of the cavity defining inner surfaces 64 and 66, about the axis 56, importantly enables all shells 20 received from the magazine 18 to be rotated through 90° for feeding into the firing chamber 26, regardless of the cross axis direction in which the shells are loaded. This feature is of particular importance when the shell fed apparatus 12 is configured for use with the illustrated, rifle-type tapered shells.

Because of case taper, and since the shells have ordinarily had to be loaded to point in a generally common direction, shell magazines holding for more than about twenty rifle-type shells generally have heretofore been curved along their length. Curvature of such shell magazines has been determined by the angle of casing taper.

In contrast, in the present case, because of symmetry of the shell feeding apparatus 12, the shells 20 are loaded in the associated magazine 18 in an alternately pointing arrangement. This arrangement, in which adjacent shells are loaded to point in alternative cross axis directions, enables the magazine 18 to be linearly configured, without curvature, regardless of shell capacity, up to a shell limit determined by shell advancing capabilities.

In addition, because of relative orientation between the magazine 18 and the shell feeding apparatus 12, the magazine is capable, as shown, of being disposed along the top (or side or bottom) of the firearm 10, so as to be parallel to, and relatively closely adjacent to, the barrel 24. Thus, regardless of magazine capacity, there exists no awkward magazine projection from the firearm 10, ease of firearm carrying and handling being greatly enhanced.

Figure 4:
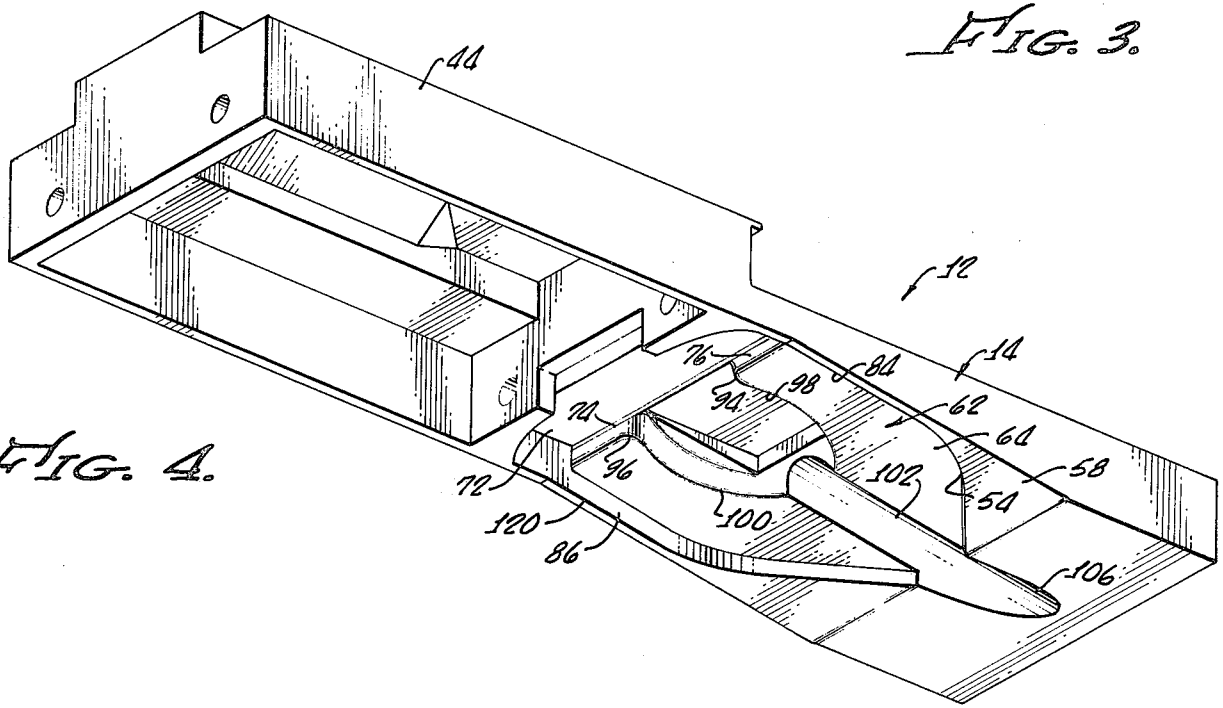
FIG. 4 is a perspective view, looking from underneath, showing features of an upper half of a shell camming portion of the cross axis shell feeding apparatus.
Figure 7:
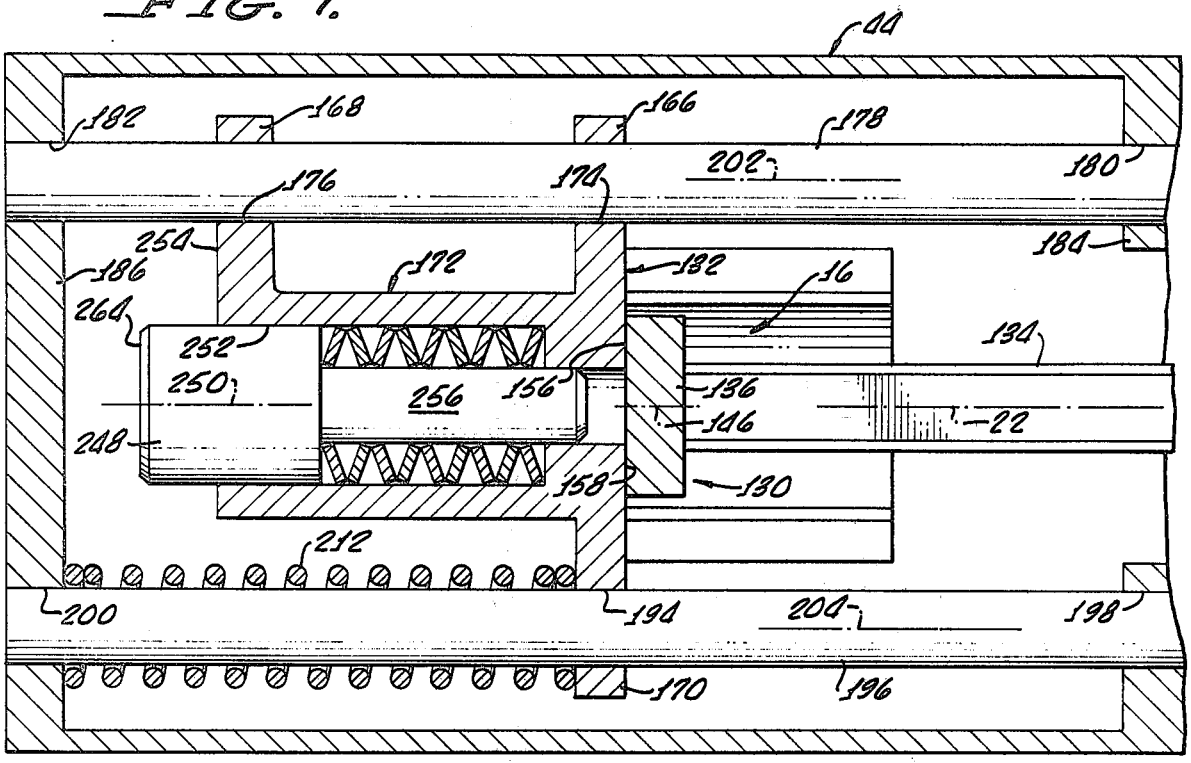
FIG. 7 is a cross sectional view, taken along line 7—7 of FIG. 3, showing actuating portions of the cross axis feeding apparatus.

Configuration of the cavity 62, assuming transverse symmetry of the cavity and symmetry (except as noted below) of the cavity forming inner walls 64 and 66, is established in the following general manner, reference being to FIGS. 4 and 5, which show upper cavity regions.

Transverse width of the cavity 62, at a rearward region, which has an elongate, rectangular shell infeed port 72 formed only in the upper inner wall 64, is made slightly greater than length of the shells 20. A transverse axis of the port 72 is coincident with the cross feed axis 54 of the shell 20*a*. Height "$h_1$" (FIG. 6) of the cavity 62 in the region of the port 72 is slightly greater than the largest diameter of the shell 20 in a shell base region. Thus, rearward regions of the cavity 62 fully receive the shells 20, one at a time.

Forwardly adjacent to a forward edge 74 of the port 72, are first and second upper, transverse shell engaging surfaces 76 and 78, respectively, which are formed by a step down in the upper inner wall 64. Such step down, taken in conjunction with a corresponding step up in the lower inner wall 66, decreases cavity height to "$h_2$" (FIG. 6). This cavity height "$h_2$" is made only slightly greater than the shell diameter at a necked down region 80 which grips a projectile 82.

These transverse shell engaging surfaces 76 and 78 extend sidewardly, from corresponding cavity inner side edges 84 and 86, in towards the longitudinal feed apparatus axis 56 a distance "$l_1$" are about equal to about ⅓ the overall length of the shells 20.

Arcuate, inner end corners 94 and 96, respectively, of the surfaces 76 and 78 are rounded off at a small radius, for example, about 1/16 of an inch, to form smooth, arcuate shell camming or pivoting surfaces which engage corresponding regions of the shells 20 (20*a*). At the arcuate corners 94 and 96, the surfaces 76 and 78 continue to arcuate surface regions 98 and 100, respectively, which forwardly and inwardly converge towards a point "C" located approximately a half shell length forwardly of the port forward edge 74. The cavity side edges 84 and 86 also converge forwardly and inwardly toward a point "D", located at a position causing generally uniform spacing between the corresponding pairs of the side edges 84 and 86 and the surface regions 98 and 100, such spacing being approximately equal to the partial shell length "$l_1$", or length of the small end of the shells 20.

Forwardly (towards the gun muzzle) of the convergence point "C", an arcuate recess 102 is formed upwardly into the upper section 58, extending forwardly along the axis 56 into proximity with a rearward face 104 (FIG. 3) around the opening to the firing chamber 26. Except for a forwardmost region 106 of the recess 102, which curves inwardly toward the axis 56 to cause shell deflection during feeding, as described below, the recess has a radius from such axis which is slightly greater than the largest radius of the shell 20, thereby providing shell clearance, while at the same time providing shell feed guidance.

Rearwardly of a rearward edge 106 of the infeed port 72 are formed generally arcuate first and second shell base engaging surfaces 114 and 116, respectively, which are rearwardly aligned with the surfaces 76 and 78. Transverse inner end regions of these surfaces 114 and 116 are separated by a gap or slot 118 having a width which provides clearance for below described portions of the rammer means 34.

Contour of the shell base engaging surfaces 114 and 116 is formed generally complimentary to that of the edges 84 and 86. That is, the surfaces 114 and 116 are contoured so that as the shell 20*a* is pivoted in the direction of Arrow "E" about the corner region 94, through an intermediate shell position represented by a phantom line shell given the reference number 20*c*, from the initial shell position 20*a* toward the fully pivoted position 20*b*, a shell base 120 slides along the surface 114 inwardly towards the axis 56 as a nose end 122 of the projectile 82 slides inwardly towards such axis along the opposite edge 86. Thus, the surfaces 114 and 116 prevent the shell from backing up as it is pivoted from the cross axis position of 20*a*, as well as for the opposite cross axis orientation.

To insure proper shell pivoting about the corner 94 (or the opposite corner 96, according to initial shell cross axis orientation) without jamming, it has been determined experimentally that the shell 20 should preferably be moved slightly forward during the pivoting action. For example, forward shell movement of about an eighth to a quarter of an inch is preferred during pivoting. As a consequence of laying out combined shell rotation and forward translation from the position 20*a* through intermediate position such as 20*c*, to the 90° rotated position 20*b*, contour of the surfaces 114 and 116 as well as that of the edges 84 and 86 is determined graphically.

Except for the described infeed port 72, the rammer clearance slot 118 and the recessed region 106, the upper and lower half sections 58 and 60 can be considered as being initially formed completely symmetrical about a transverse plane through the axis 56. However, to provide necessary clearance for portions of the rammer means 34, some regions of the lower section 58 must normally be cut away (or eliminated during construction) in a somewhat irregular, but symmetrical manner. Extent of such cutting away is necessarily determined both by configuration of interferring portions of the ramming means 34 and the angle "A" between the turn around portion axis 56 and the barrel bore axis 22, as is apparent in the ensuing discussion. As a result of this general symmetry, shells are engaged in upper and lower regions during the pivoting and translation operation to enable reliable shell turn around, regardless of the position in which the gun 10 is held.

As seen in FIGS. 3 and 7–9, the shell rammer means 34 comprises first and second stage shell rammers 130 and 132, respectively. Formed in general "L" shape, as seen in longitudinal, vertical cross section (FIG. 3), the first stage rammer 130 comprises a rigid but relatively long slender, forwardly projecting leg 134 and, formed at right angles thereto, a rammer mounting portion 136.

An axial pivot pin 138, projecting rearwardly from upper regions of the first stage rammer mounting portion 136 passes through, on assembly, an associated receiving aperture 140 formed in the second stage rammer 132, limited, side-to-side pivoting of the first stage rammer relative to the second stage rammer (in a direction of Arrow "F—F" FIGS. 8 and 9) being thereby enabled. A retaining ring 142, mounted in an annular groove 144 formed adjacent to a rearward end of the pin 138 is used to retain the pin in the aperture 140. When assembled, a longitudinal axis 146 of the pin 138 is parallel to, but offset above (for the firearm orientation of FIG. 3) the barrel bore axis 22.

Forward regions of the first stage rammer leg 134 which extend forwardly to a transverse rammer face 150 (FIG. 3) has a longitudinal arcuate recess 152 (FIGS. 8 and 9) formed in each leg side, radius of the two opposing recesses being slightly greater than the largest (base) diameter of the shells 20. Length of the rammer leg 134 is sufficient that the rammer face 150 is forward of a corresponding transverse ramming face 154 of the second stage rammer 132 a distance "$l_2$" (FIG. 3) which is approximately equal to one half the total length of the shells 20.

The first and second stage rammers 130 and 132 are relatively configured in a manner that the second stage rammer provides rearward, back up support for the first stage rammer. To this end, on assembly, a rearward face 156 of the first rammer portion 136 abutts or bears against a forward face 158 of the second rammer 132. In a like manner, a rearward face 160, located at an approximately mid-length step in the first rammer leg 134, abutts or bears against the second stage rammer face 154. Mounting of, and reciprocating movement guiding for, the rammer means 34 is provided by first, second and third arms 166, 168 and 170, respectively (FIG. 7), which project sidewardly from a main portion 172 of the second stage rammer 132. The arms 166 and 168 project to one side of the second rammer 132 from forward and rearward ends, respectively, of the portion 172. Projecting from an opposite side of the second rammer portion 172, in transverse alignment with the first arm 166 is the third arm 170.

Axially aligned apertures 174 and 176 in the two arms 166 and 168, respectively, enable mounting of one side of the second rammer 132, and hence of the entire ramming means 16, to a first cylindrical mounting rod or rail 178. Ends of the first mounting rod 178 are, in turn, received into apertures 180 and 182, formed, respectively, in and forward and rearward receiver walls 184 and 186.

In a similar manner, an aperture 194 in the third arm 170 enables mounting of the other side of the rammer 132 (and hence the ramming means 16) to a second cylindrical mounting rod or rail 196 which is parallel to, and laterally spaced from, the first rod 178. Ends of the second rod 196 are received in apertures 198 and 200 formed in the receiver walls 184 and 186, respectively. To provide symmetrical mounting of the rammer means 16, longitudinal axis 202 and 204 of the two mounting rods 178 and 196, respectively, are symmetrically located relative to the barrel bore axis 22, but are offset thereabove.

Forward drive of the rammer means 16, upon release for firing from a conventional sear (not shown) is provided by a strong compression spring 212 which is disposed around the second support rod 196 between the receiver rearward wall 186 and the second rammer arm 170.

In transverse cross section (FIGS. 8 and 9), a forwardly projecting portion 214 of the second stage rammer 132 is generally shaped in an inverted "C" channel form, having first and second laterally spaced apart, upright legs 216 and 218, respectively, lower ends of which are joined by a transverse web 220. An arcuate upper surface 222 of the web 220, as seen in transverse cross section, has a center of radius on the first rammer axis 146 (FIGS. 8 and 9), curvature of the surface 222 matching or being about equal to curvature of a lower surface 224 of the first rammer forward portion 134, both of such surfaces, on assembly, being closely adjacent to, or in rotationally sliding contact with one another.

Spacing between opposing inner surfaces 232 and 234, respectively, of the first and second legs 216 and 218 is selected, relative to with the first rammer forward portion 134, to enable the first stage rammer 130 to pivot through approximately 10° to both sides of a vertical plane (for the gun orientation depicted) through the first rammer pivot axis 146. Thus the surfaces 232 and 234 limit pivotal movement of the first stage rammer 130 relative to the second stage rammer 132. Cooperating with the surfaces 232 and 234, for controlling pivotal movement of the first stage rammer 130, is an upwardly projecting slotted portion 236 of the receiver 44.

Figure 9:
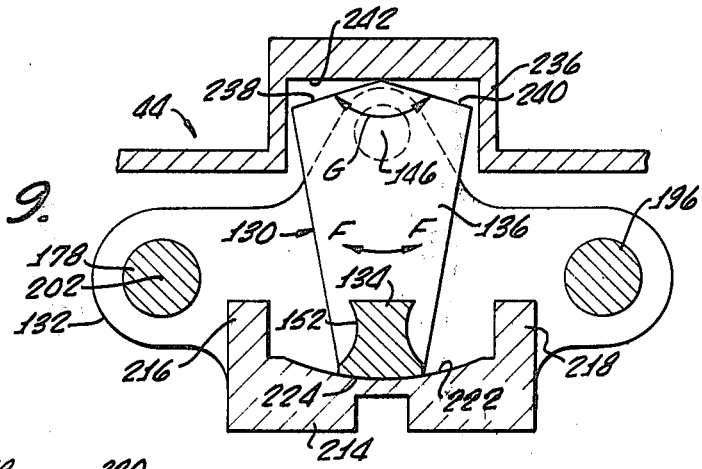
FIG. 9 is transverse cross sectional view, taken along line 9—9 of FIG. 3, showing forward regions of the cross axis shell feeding apparatus actuating portion.

As can be seen in FIGS. 8 and 9, upper regions of the first rammer mounting portion 136 include first and second upper surface segments 238 and 240, respectively, which intersect at a large angle "G" of about 160°. In regions of the receiver portion 236 rearwardly of a point "H", which corresponds to position of the surface segments 238 and 240 when the first rammer shell engaging surface 150 is just rearwardly of the shell 20*a* (FIG. 3), configuration of an upper surface 242 is closely adjacent to, and matches, that of the surface segments 238 and 240 when the first rammer 130 is centered (FIG. 8). Consequently, whenever the surface segments 238 and 240 are rearwardly of the point "H", engagement thereby with the inner surface 242 prevents any pivotal movement of the first stage rammer 130 from its vertically centered position.

Forwardly of a more forward point "J", corresponding to a rammer position causing the shell 20*a* to be rotated through approximately 45° by the first rammer 130, the upwardly projecting receiver inner surface 242 is planar in transverse cross section (FIG. 9). This planar surface configuration enables pivoting of the first rammer 130 about its pivot axis 146 as is necessary to permit the leg 134 to swing sideways out of shell engagement, as described below. Between the two points "J" and "H", the upper inner surface 242 gradually tapers between the described planar and angled configuration to cause, by a ramping or wedging effect, central positioning of the first rammer 130 as the ramming means 16 travels rearwardly after firing.

For convenience, compactness and economy of construction, the second rammer 132 also incorporates the recoil buffer assembly 42. Comprising the buffer assembly 42 is a generally cylindrical buffer piston 248 having, on assembly, a longitudinal axis 250 parallel to, but vertically displaced from the barrel bore axis 22 (FIG.

3). The piston 248 is axially slidingly disposed in a cylindrical recess 252 formed forwardly into the second rammer portion 172 from a rearward face 254 thereof.

Disposed around a reduced diameter, forwardly projecting portion 256 of the buffer piston 248, between an annular surface 258 at the rear of such portion and an annular shoulder 260 within the recess 252, is a mechanical buffer spring 262 of compression type. Retaining means (not shown) retain the piston 248 in the aperture 252 against the spring 262, with a rearward, receiver impacting face 264 of the piston substantially rearwardly of the second rammer rearward face 254.

The bolt assembly 36, comprising the bolt 38 and the bolt carrier 40, may be of any generally conventional configuration enabling limited relative axial movement therebetween. Axially reciprocal movement of the bolt assembly 36 during gun firing, is guided by conventional, mating track means 266 on the bolt assembly 36 and the receiver 44.

Also included in the bolt assembly 36 may be conventional bolt locking means (not shown), which operate to lock the bolt 38 to the receiver 44, rearwardly adjacent to the firing chamber 26, during firing. Operationally associated with bolt assembly 36 (and also not shown) are conventional bolt carrier recoil means for causing unlocking of the bolt 38 after firing, such recoil means may include barrel gas operated pistons connected to the bolt carrier 40 for driving the bolt carrier rearwardly, thereby enabling unlocking of the bolt 38 a preselected time, for example, several milliseconds after firing.

Longitudinal guiding of the bolt 38, relative to the ramming means 16, is provided by a longitudinal ridge or ear 270 (FIGS. 3 and 8) extending upwardly from an upper bolt surface 272 into a mating recess 274 formed upwardly into the second rammer portion 220 from a lower surface 276 thereof.

Relative configuration of the bolt ear 270 and the mating second stage rammer recess 274 is such that when the bolt is fully rearwardly, with a rearward end 280 of the ear abutting a rearward surface 282 of the recess, a forward transverse bolt face 284 is flush with the second rammer forward surface 154. As described below, the bolt ear 270 is also operative for picking up fully rotated shells in the turnaround means 14.

As shown in FIG. 3, major portions of the bolt carrier 40 are ordinarily spaced slightly rearwardly from the bolt 38, by a gap 286. The gap 286 is such that a forward, shell primer impacting end of a bolt carrier mounted firing pin 288, which extends into an axial recess 290 through the bolt 38, is normally rearwardly recessed behind the bolt face 284. Axis of the firing pin 288 and mating bolt recess 290 are along the barrel bore axis 22.

Figure 10:
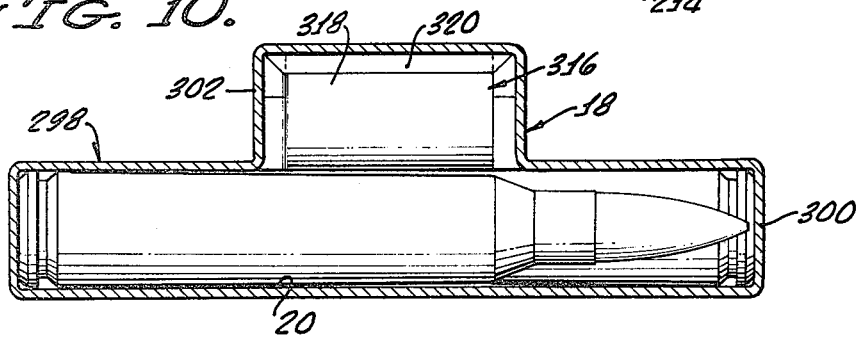
FIG. 10 is a transverse cross sectional view, taken along line 10—10 of FIG. 3, showing a shell magazine associated with the cross axis shell feeding apparatus.

Associated with the shell cross feed apparatus 12 is the shell magazine 18 (FIGS. 3 and 10) which contains the shells 20 in alternating or mixed cross axis arrangement. Assuming, as shown, the shells 20 are tapered casing rifle types an alternating cross feed arrangement is necessary for reliable feeding from a linear (uncurved) magazine. Although a double, staggered column shell arrangement may alternatively be used, in the magazine, only a single column magazine is shown.

Comprising the magazine 18 is a housing 298 having a wide, rectangular lower shell containing portion 300 and a narrow rectangular upper portion 302 for shell anti-back up control. A slidable feed lip 304, urged by a spring 306, is configured with an arcuate inner surface 308 for guiding the shells 20 downwardly (for the gun orientation shown) through a magazine shell exit opening 310 into the infeed port 72 of the turnaround means 14.

A shell follower 312, driven by a spring 314 is shown used to urge the shells 20 in the magazine 18 towards the exit opening 310. Mounted to upper regions of the follower 312 are anti-back up means 318, a spring loaded element 316 of which engages steps 320 formed in the upper magazine portion 302. The anti-back up means 316 eliminates any tendency of the shell **20*a* in the infeed port 72 from being driven or pushed back into the magazine 18 by initial ramming engagement by the first rammer 130. For loading the magazine, the element 316 may be released from the steps 320** by release means (not shown).

Releasable attachment of the magazine 18 to the gun 10 may be by generally conventional spring loaded clip retaining and release means, not shown.

As above mentioned, the gun 10 may be of any type configured for employing the cross axis feed apparatus 12, preferably being also adapted for accepting the cross axis magazine 18, although projecting or other types of shell supply means may alternatively be used. The particular type gun 10 is shown, for illustrative purposes, with no limitations intended or implied, as a two-hand held rifle having no shoulder stock.

Symmetrical holding for the gun 10 is enabled by first and second hand grips or handles 326 and 328, respectively, (FIGS. 1 and 2) positioned on opposite sides of the barrel 24 at an approximate rifle balance point. An adjustable shoulder and carrying sling 330, attached to the rear end of the receiver 44, may be utilized to additionally support the gun 10 from a user's shoulder during firing. Firing of the gun is by a trigger 332 associated with the first handle 328. Other than as shown, the gun 10 may be of conventional, for example, gas operated type.

OPERATION

Operation of the cross axis feed apparatus 12, although generally apparent from the foregoing description, is additionally depicted in FIGS. 11–18, which are in the form of time sequence representations.

With the loaded magazine 18 attached to the gun 10, the rammer means 16 and the bolt assembly 36 are moved rearwardly, for example, by an exposed charging handle (not shown) until both are seared up by conventional searing means (also not shown). The end one of the shells 20 in the magazine is forced by the follower spring 312 through the magazine exit opening 310 and infeed opening 72 of the turnaround portion 14, into the cross axis shell position **20*a* (FIG. 3). The gun 10** is now ready for firing.

When the gun 10 is fired, by the trigger 332, the rammer means 16 and the bolt assembly 36 are unseared and driven forwardly toward the breech 26 by the rammer drive spring 212 (FIG. 7) and by the bolt return spring (not shown). As the rammer means 16 moves forwardly, the forward end 150 of the first stage rammer member 134 engages through the gap 118, mid regions of the shell in the position **20*a*. During this initial shell engagement the first stage rammer 132 is kept centered by the angled inner surface 242 of the receiver 44 (FIG. 8**).

As the spring 212 continues driving the rammer means 16 forwardly, the first stage rammer 132 pushes on the shell, in position **20*a***, in the turnaround portion 14 and starts pivoting the shell around the upper pivot points 94 or 96, according to cross axis orientation, and a corresponding one of the corresponding lower pivot points. The shell projectile 120 thus starts pivoting towards alignment with the turnaround means axis 56. During this initial pivoting of the shell, the shell base 120 engages and moves along the upper rear surfaces 114 or 116 and a and a corresponding one of the corresponding lower rear surfaces, thereby causing the shell to start moving forwardly as is important to enable camming action of the shell around the mentioned pivot points without jamming.

Figure 11:
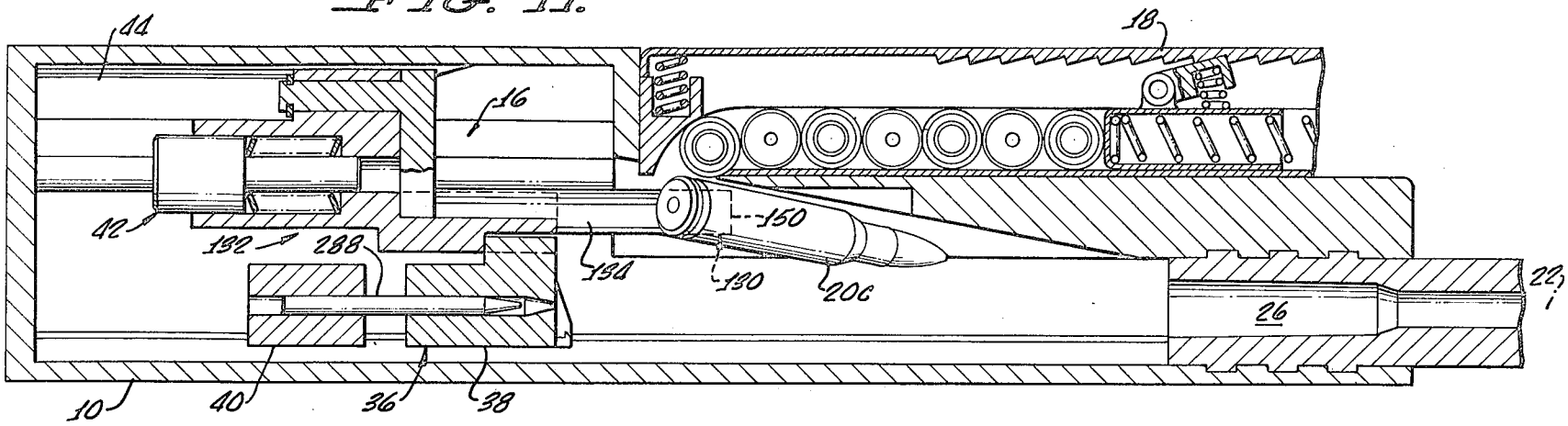
FIG. 11 is a longitudinal cross sectional view, similar to that of FIG. 3, showing position of the actuating portion corresponding to a shell being pivoted approximately 45° in the shell camming portion.
Figure 12:
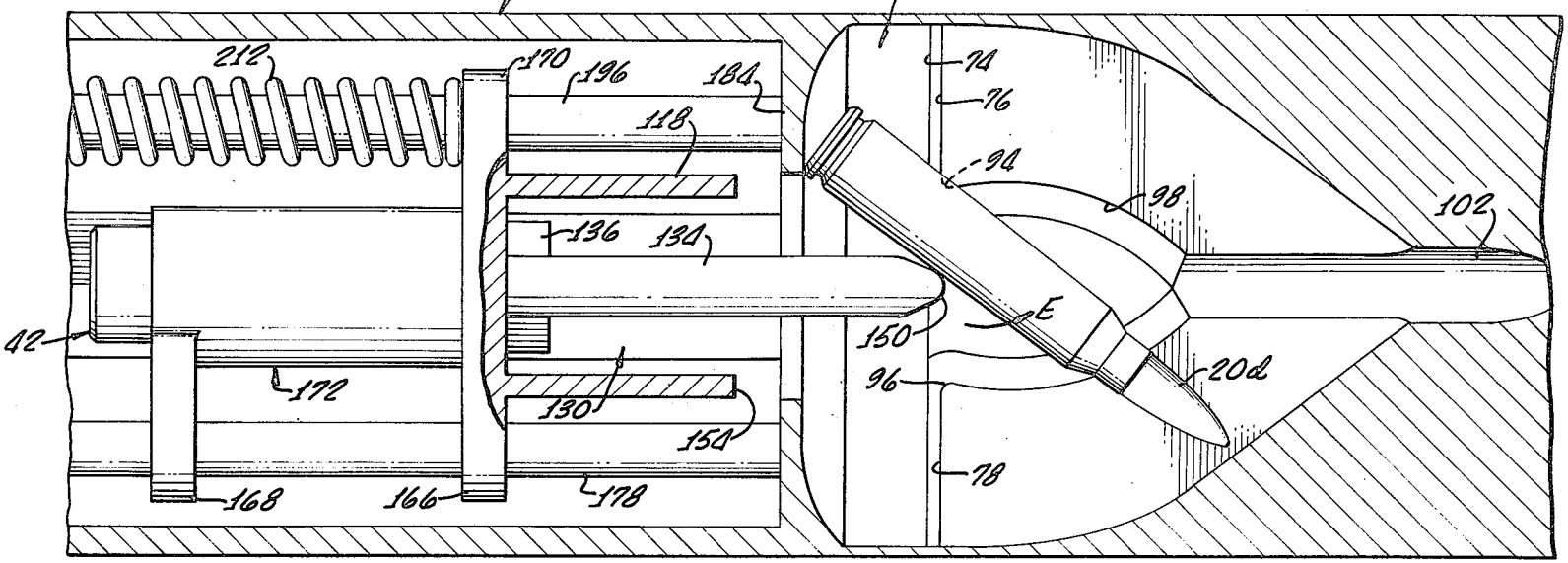
FIG. 12 is a cross sectional view, similar to that of FIG. 4, but corresponding to the instant in time depicted in FIG. 11, showing a shell rotated through approximately 45° in the shell camming portion.

At the instant in time represented by FIGS. 11 and 12, the shell initially in the cross axis position 20*a*, has been pivoted about 45°, in the direction of Arrow E, to the intermediate position 20*c*. This is in response to the rammer means 16 moving forwardly in the direction of Arrow K, with the first stage rammer forward surface 150 in engagement with central regions of the shell. As can be seen in FIG. 12, to enable the shell to freely pivot and also slide forwardly about the upper pivot corner 94 (and the corresponding lower pivot corner), the first stage projecting member 134 also starts swinging aside (direction of Arrow F) relative to the second stage rammer 132. However, pushing engagement with the shell is still maintained by the member 134, pivoting in the direction of Arrow F being controlled or limited by configuration of the transition region of the receiver inner surface 242 (FIGS. 8 and 9). Pivoting aside of the first stage rammer 130 is controlled by the surface 242, since pushing engagement with the shell will not be properly maintained if the first stage rammer pivots aside too soon or too rapidly.

As can also be seen from FIG. 12, by the time the shell pivots through a large enough angle that the shell base 120 closely approaches the edge of the gap 118, the forward, shell engaging surface 154 of the second stage rammer 132 has moved forwardly to a position closely approaching the shell base. Thus, when the shell has been pivoted through about 75° by the first stage rammer 130, to the position 20*d*, the first stage rammer 130 pivots aside completely out of pushing engagement with the shell. At this point, however, the shell has been pivoted through an angle sufficient for the base 120 to be in position for pushing engagement by the second stage rammer surface 154.

Figure 13:
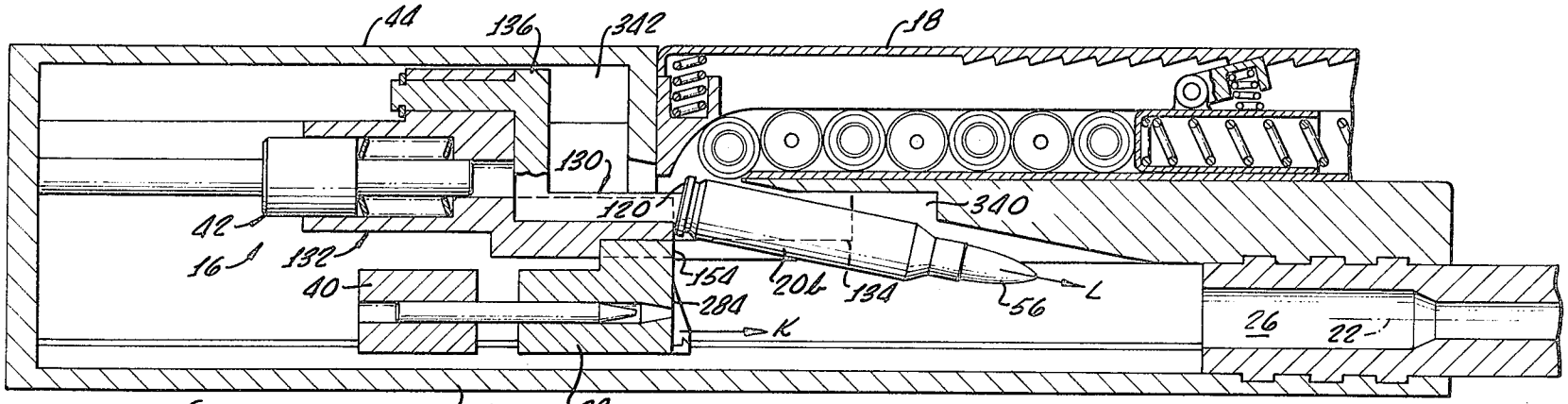
FIG. 13 is a longitudinal cross sectional view, similar to that of FIG. 11, but representing an instant later in time, showing a shell rotated through 90° in the shell camming portion.
Figure 14:
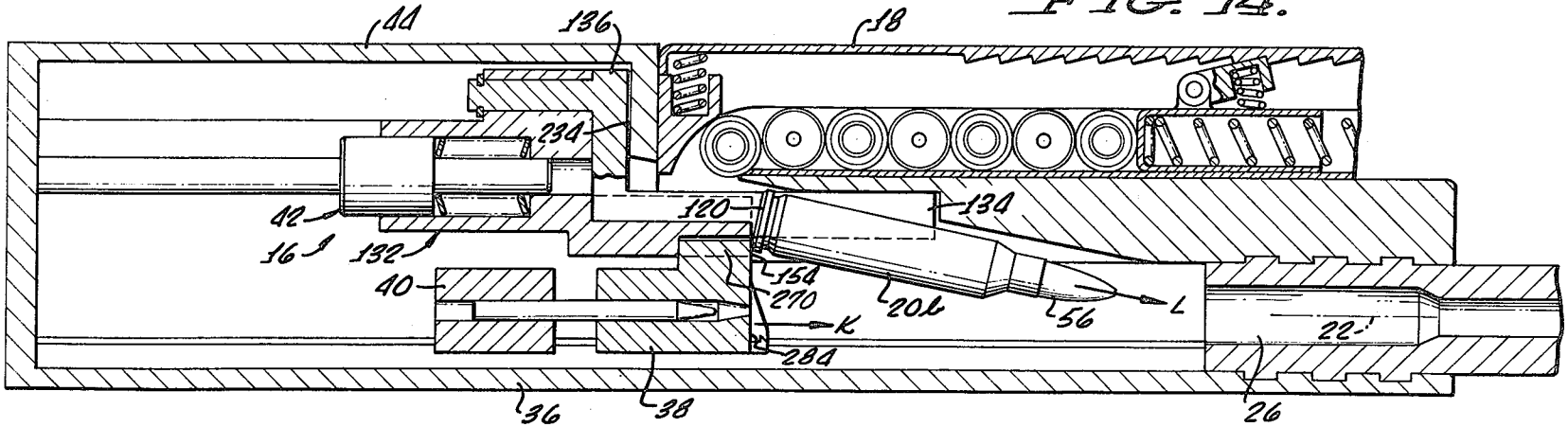
FIG. 14 is a longitudinal cross sectional view, similar to that of FIG. 13, but representing an instant still later in time, showing the fully rotated shell being pushed through the shell camming portion by the actuating portion.
Figure 15:
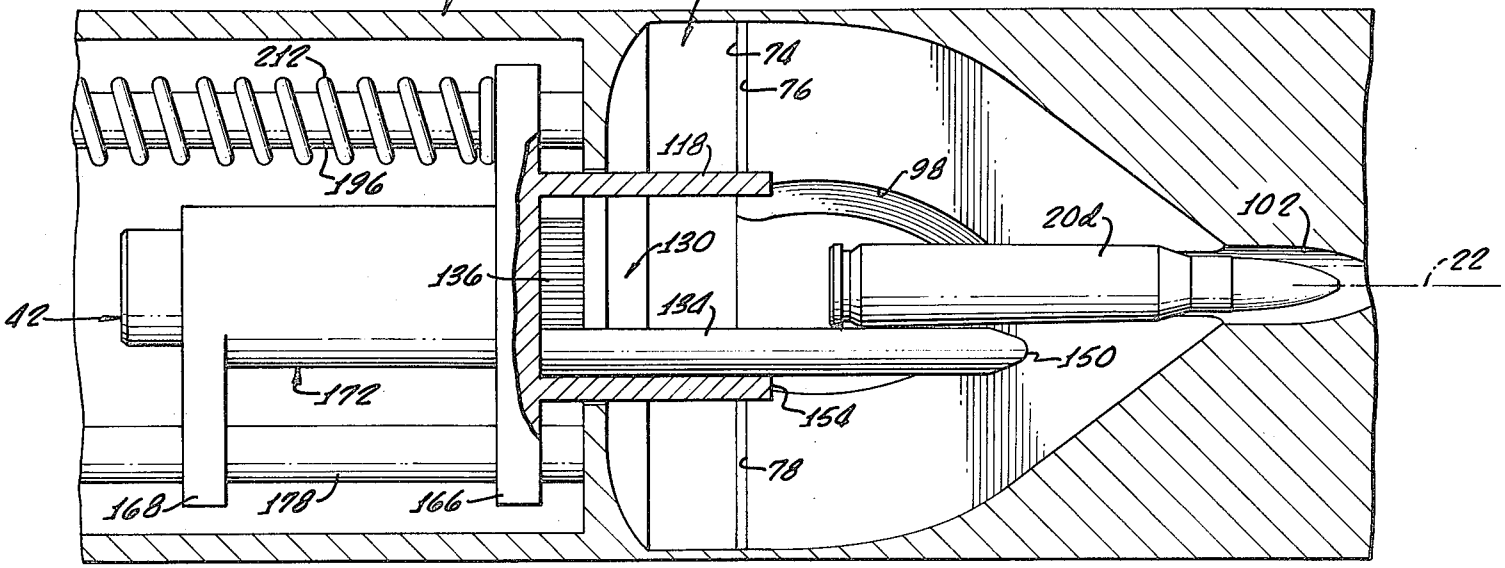
FIG. 15 is a transverse cross sectional view, similar to that of FIG. 12, but corresponding to the instant in time depicted in FIG. 14.

FIG. 13 illustrates an instant still later in time, when the second stage rammer 132, still moving forwardly in the direction of Arrow K, has caused complete pivoting of the shell through 90°, into the position 20*b*, and is continuing to push the shell through the turnaround portion 14, in the direction of Arrow L (along the turnaround portion axis 56), towards the barrel firing chamber 26. For clearance purposes, forward regions of the first stage rammer member 134 are received into recessed region 340 formed upwardly from the cavity 62.

Figure 16:
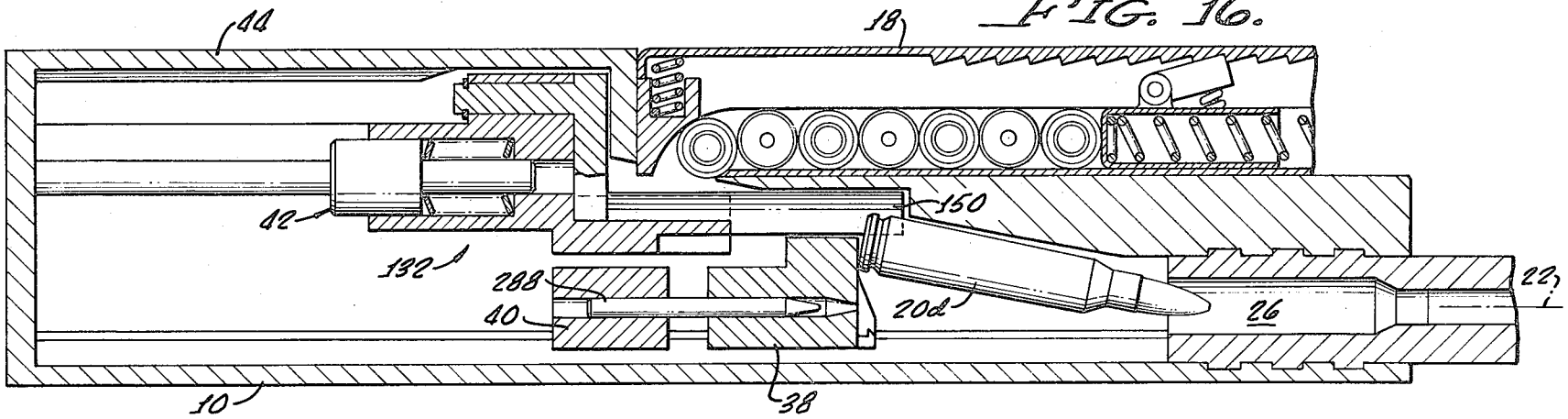
FIG. 16 is a transverse cross sectional view, similar to that of FIG. 14 but representing an instant later in time, showing a bolt of the actuating portion in driving engagement with the rotated shell.
Figure 17:
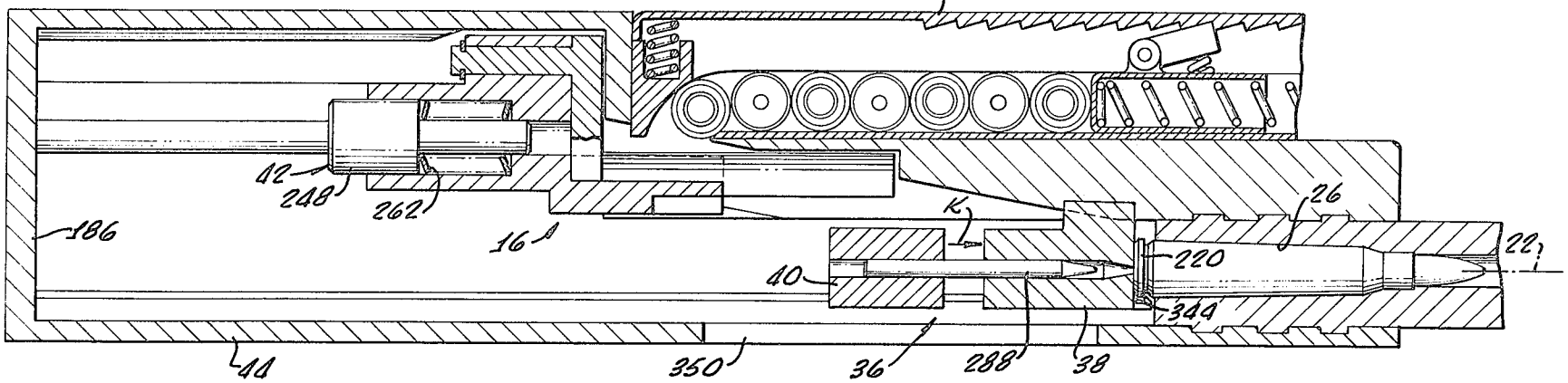
FIG. 17 is a longitudinal cross sectional view, similar to that of FIG. 16, but representing an instant later in time, showing the rotated shell moved forwardly and fully chambered for firing.
Figure 18:
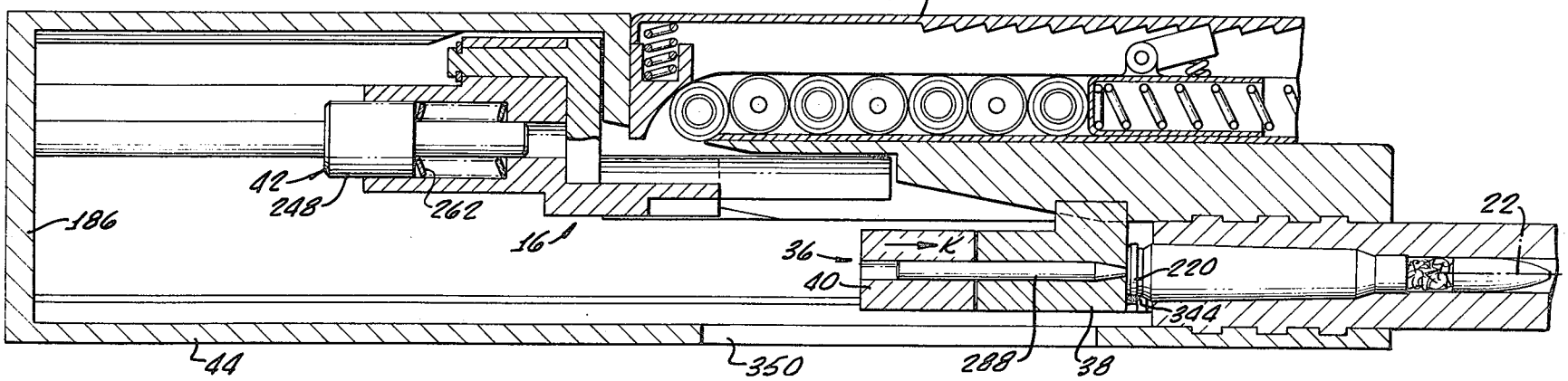
FIG. 18 is a longitudinal cross sectional view, similar to that of FIG. 17, but representing an instant later in time, showing a firing pin of the actuating portion positioned in firing engagement with the chambered shell; and, FIG. 19 is a perspective drawing illustrating a manner in which the cross axis shell feeding apparatus may be used to advantage in a machine gun using belted ammunition.

When the rammer means 16 reaches its extreme forward limit of travel (FIGS. 14 and 15), such that the first stage rammer portion 136 abuts a receiver rearward surface 342, the bolt forward face 284, in the region of the bolt ear 270, drivingly engages the shell base 122. Although forward travel of the rammer means 16 stops at this point, the bolt assembly 36 continues moving forwardly in the direction of Arrow K, because of its inertia and because of the force exerted by the bolt return spring (not shown), pushing the shell forwardly towards, and into, the firing chamber 26 (FIG. 16).

When the shell has been pushed completely into the firing chamber, the bolt 28 impacts a rearward face 344 of the barrel 22 (or of firing chamber 26) and stops, being then temporarily locked into this position, for example, by conventional bolt locking means (not shown), during shell firing, as is normally required.

Both inertia and the force exerted by the bolt return spring (not shown), however, causes the bolt carrier 40 to continue its forward movement (direction of Arrow K), so that an instant later (FIG. 18), the bolt carrier mounted firing pin 288 impacts the chambered shell and causes firing thereof.

In a conventional manner, for example, by action of barrel gas pressure on recoil means (not shown), the bolt 38 is unlocked and is driven rearwardly in recoil with the bolt carrier 40 a few milliseconds after firing. During such recoil, the fired shell casing is extracted and ejected through an ejection port 350 formed in lower regions of the receiver 44. When the bolt assembly 36 recoils to the rammer means 16 position, the rammer means is picked up and is driven thereby rearwardly in recoil due to bolt recoil inertia. As the first stage rammer member 134 moves rearwardly from the port 72, a next shell 20 is pushed by the follower spring 314 from the magazine 18 into the position 20*a* in the turnaround portion 14.

Rearward recoil of the bolt assembly 36 and the rammer means 16 continues until the buffer piston 248 impacts the receiver rear wall 186. In response to such impact, the buffer spring 262 is compressed, thereby stopping the rammer means and bolt assembly recoil and imparting counterrecoil thereto.

Assuming fully automatic operation of the gun 10, this counterrecoil continues. The first stage rammer 130 engages the next shell 20 which has just been moved into the position 20*a* and the just described shell pivoting, loading and firing is repeated. The only difference is that each successive shell, assuming an opposite cross axis orientation relative to the first shell, is pivoted 90° in the opposite direction in the shell turnaround portion 14.

Successive shell pivoting, loading and firing continues in this repetitive manner until firing is either interrupted by searing up or the magazine 18 is emptied. When the magazine 18 is empty, the empty magazine is replaced by a full magazine.

VARIATION OF FIGURE 19

Figure 19:
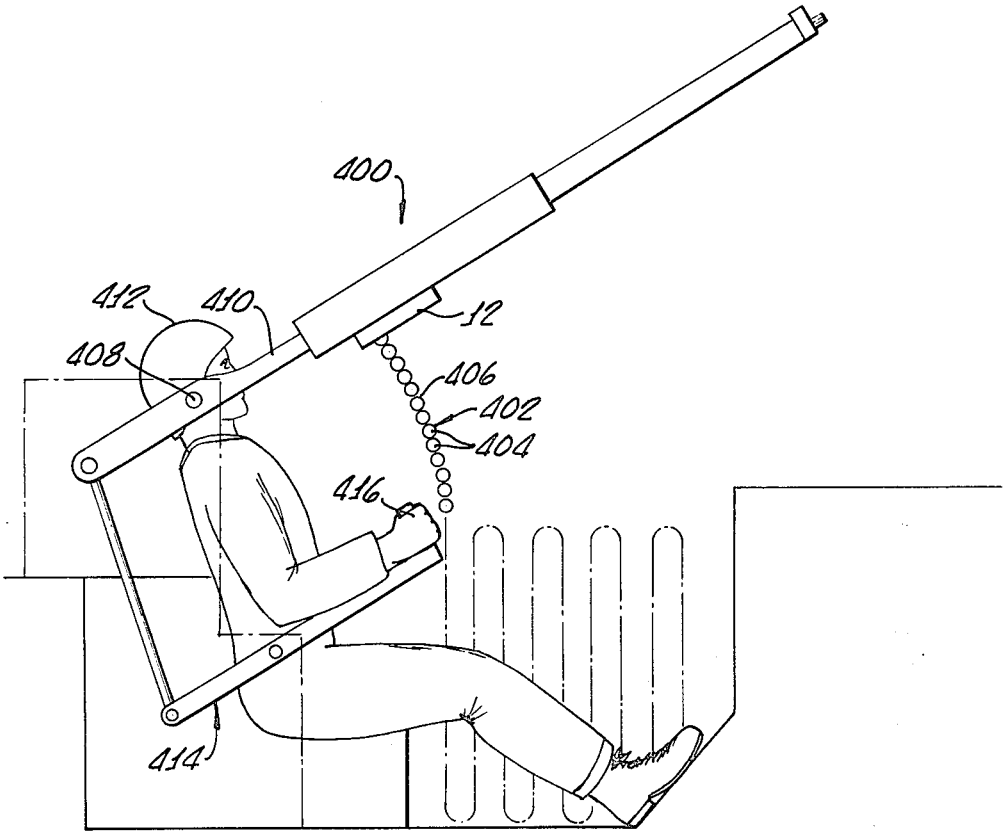

Substantial advantages can be achieved by using the described shell cross feed apparatus 12 with guns having types of shell supply means other than the described magazine 18. As an exemplary illustration, FIG. 19 depicts use of the cross feed apparatus 12 with a belt fed machine gun or automatic cannon 400, particularly of a type adapted for use against enemy aircraft. An ammunition belt 402, which may be a linked type, feeding the gun 400 is mounted so that shells 404 held therein are in a cross axis orientation to enable feeding into the cross axis feed apparatus 12 which is incorporated into the gun.

This cross axis, belt feeding arrangement overcomes a problem associated with machine guns and automatic cannon which are belt fed in a conventional manner. Because of the manner of construction, virtually all ammunition belts are relatively flexible only in a direction about the connecting links between shells; in the fore-aft direction, the belts are quite inflexible. In consequence, guns belt fed in the conventional manner must ordinarily be pivotally mounted for elevational movement about an axis close to the belt infeed location. Although such elevational mounting minimizes the amount of fore-aft belt flexing required, such elevational axis positioning is disadvantageous if the gun requires substantial elevational movement, as is necessary for antiaircraft applications. Because the gun elevational pivot axis is substantially offset from the natural elevational pivot axis of the operator's head, target tracking and accuracy of firing is substantially impaired.

In contrast, by feeding the belt 402 in the cross axis manner shown in FIG. 19, belt pivotal axes 406 between shells 404 are parallel to, rather than orthogonal to, a gun elevational pivot axis 408, this enables the elevational pivot axis 408 to be located through rearwardly projecting frame portions 410 of the gun 400 so as to be generally coincident with the elevational pivot axis of an operator's head 412. Thus, the gun elevational pivot axis 408 extends through the operator's head 412 approximately in the ear region, when the operator's head is in a normal, gun sighting position. Manual elevational control or movement is through linkage means 414 operated by the operator's hands 416.

When connected in this cross axis manner, normal belt flexibility between the shells 404 permits the belt 402 to be of large shell capacity and be draped in the folded manner shown beneath the gun 400, enabling the gun to be easily and rapidly elevated about the elevational pivot axis 408, as is necessary to defend against fast attacking aircraft.

Although there has been described above a specific arrangement of shell cross feed apparatus, for firearms, including hand held weapons, machine guns and automatic cannons, in accordance with the invention for purposes of illustrating the manner in which the invention may be used to advantage, it will be appreciated that the invention is not limited thereto. Accordingly, any and all modifications, variations or equivalent arrangements which may occur to those skilled in the art should be considered to be within the scope of the invention as defined in the appended claims.

What is claimed is:

1. Cross axis shell feed apparatus for a gun having a barrel with a rearwardly opening firing chamber; which comprises:

(a) shell supply means adapted for containing a plurality of shells in cross axis orientation relative to a bore axis through the barrel;

(b) shell pivoting means for pivoting shells from the supply means through 90 degrees so that longitudinal shell axes are coplanar with said barrel bore axis and the shells are correctly pointing for loading into the firing chamber, said shell pivoting means having means defining a shell infeed opening positioned to receive shells from the shell supply means and defining a shell outfeed opening at 90 degrees thereto, and having internal camming means for causing 90 degree shell pivoting as a shell is moved from said infeed opening to said outfeed opening;

(c) shell ramming means for pushing shells, one at a time, through said shell pivoting means to thereby cause the 90 degree shell pivoting, said ramming means including a first stage rammer configured for engaging and pushing shells partially through the shell pivoting means to cause partial 90° shell pivoting, disengaging means for then enabling disengagement of the first stage rammer from the shell, and a second stage rammer configured for then engaging the shells to cause completion of 90° shell pivoting and pushing of the shells on through said shell pivoting means;

(d) means for axially moving said ramming means, in synchronization with firing of the gun, in a reciprocating manner for enabling a sequence of shells to be pushed through the shell rotating means and pivoted 90° for feeding from the shell supply means to the firing chamber; and (e) means for moving shells from said outfeed aperture into said firing chamber for firing.

2. The cross axis shell feed apparatus according to claim 1, wherein said shell supply means is configured for containing shells oriented in either cross axis direction and wherein said shell pivoting means are symmetrically configured about a longitudinal axis therethrough to enable 90 degree pivotal movement of shells received in either cross axis orientation.

3. The cross axis shell feed apparatus according to claim 1, wherein said disengaging means includes means for mounting the first rammer relative to the second rammer for sideward pivoting relative thereto.

4. The cross axis shell feed apparatus according to claim 1, wherein said shell supply means includes a linear shell magazine having means defining a shell feeding aperture at one end thereof and means for attaching the magazine to the gun with the shell feeding aperture thereof in proximity to the infeed opening of the shell pivoting means.

5. The cross axis shell feed apparatus according to claim 4, wherein said magazine attaching means is configured for attaching the magazine to the gun in an orientation wherein a longitudinal axis of the magazine is substantially parallel to the barrel bore axis.

6. Cross axis shell feed apparatus for a gun having a barrel with a rearwardly opening firing chamber; which comprises:

(a) shell supply means adapted for containing a plurality of shells in cross axis orientation relative to a bore axis through the barrel;

(b) shell pivoting means for pivoting shells from the supply means through 90 degrees so that longitudinal shell axes are coplanar with said barrel bore axis and the shells are pointing toward the firing chamber, said shell pivoting means having means defining a cross axis, shell infeed opening configured to receive shells from the shell supply means and defining a shell outfeed opening at 90 degrees thereto, and having internal camming surfaces configured for causing 90 degree shell pivoting as a shell is moved from said infeed opening to said outfeed opening;

(c) shell ramming means for pushing shells, one at a time, through said shell pivoting means to thereby cause the 90 degree shell pivoting, said ramming means including first and second stage rammers, said first stage rammer being pivotally mounted to said second stage rammer for limited side-to-side pivoting relative thereto, said first stage rammer having an elongate, forwardly extending shell engaging member, said first stage rammer being configured and operative for engaging and pushing shells partially through the shell pivoting means, to cause partial 90 degree shell pivoting, and for then pivoting aside relative to the second stage rammer out of shell engagement, the second stage rammer being configured and operative for then engaging the shells to cause completion of 90 degree shell pivoting and pushing of the shells on through said shell pivoting means;

(d) means for axially moving said ramming means, in synchronization with firing of the gun, in a reciprocating manner for enabling a sequence of shells to be pushed through the shell rotating means and pivoted 90° for feeding from the shell supply means to the firing chamber; and (e) means for moving shells from said outfeed aperture into said firing chamber for firing.

7. The cross axis shell feed apparatus according to claim 6, wherein said shell supply means includes a linear shell magazine configured for containing shells oriented in either cross axis direction and means for detachably connecting the magazine to the gun with a shell feeding opening of the magazine in shell transferring relationship with the infeed opening of the shell pivoting means, and wherein said shell pivoting means are symmetrically configured about a longitudinal axis therethrough to enable 90 degree pivotal movement of shells received in either cross axis orientation.

8. The cross axis shell feed apparatus according to claim 7, wherein said magazine connecting means is configured for attaching the magazine to the gun in an orientation wherein a longitudinal axis of the magazine is substantially parallel to the barrel bore axis.

9. The cross axis shell feed apparatus according to claim 6, including means responsive to rearward movement of the rammer means for causing pivotal recentering of the first stage rammer relative to the second stage rammer.

* * * * *